US008245877B2

(12) United States Patent
Ophardt

(10) Patent No.: US 8,245,877 B2
(45) Date of Patent: Aug. 21, 2012

(54) DISPENSER WITH PALM READER

(75) Inventor: Heiner Ophardt, Vineland (CA)

(73) Assignee: Gotohti.com Inc., Ontario (CA)

( * ) Notice: Subject to any disclaimer, the term of this patent is extended or adjusted under 35 U.S.C. 154(b) by 465 days.

(21) Appl. No.: 12/458,792

(22) Filed: Jul. 22, 2009

(65) Prior Publication Data

US 2011/0017769 A1 Jan. 27, 2011

(51) Int. Cl.
*B67B 7/00* (2006.01)
*B67B 7/06* (2006.01)

(52) U.S. Cl. ..... 222/1; 222/52; 222/63; 222/181.3

(58) Field of Classification Search ..... 222/173, 222/181.1, 181.3, 325, 63, 52, 1
See application file for complete search history.

(56) References Cited

U.S. PATENT DOCUMENTS 4,032,889 A 6/1977 Nassimbene
4,797,840 A 1/1989 Fraden
4,938,384 A 7/1990 Pilolla et al.
4,967,935 A * 11/1990 Celest ..... 222/52
5,255,822 A * 10/1993 Mease et al. ..... 222/63
5,836,482 A 11/1998 Ophardt
6,129,673 A * 10/2000 Fraden ..... 600/474
6,409,050 B1 6/2002 Ophardt
7,081,951 B2 7/2006 Carver et al.
7,184,576 B2 2/2007 Kono et al.
7,270,250 B2 9/2007 Jones et al.
7,367,477 B2 5/2008 Ophardt
2006/0080547 A1 4/2006 Higashiura et al.
2007/0206098 A1 9/2007 Matsuo et al.
2008/0065901 A1 * 3/2008 Takaku et al. ..... 713/186
2008/0100441 A1 * 5/2008 Prodanovich et al. ..... 340/572.1
2008/0107309 A1 * 5/2008 Cerni ..... 382/115
2008/0308574 A1 12/2008 Ophardt
2010/0230435 A1 * 9/2010 Wegelin ..... 222/52

* cited by examiner

*Primary Examiner* — Kevin P Shaver
*Assistant Examiner* — Nicholas Weiss
(74) *Attorney, Agent, or Firm* — Thorpe North & Western LLP

(57) ABSTRACT

A dispenser, more particularly, a hand cleaner dispenser incorporating a reader for a user's hand in the form of a palm reader which avoids the need for contact between the user's hand and the dispenser yet provides opportunity for the monitoring of usage including determining the identities of users.

4 Claims, 13 Drawing Sheets

DISPENSER WITH PALM READER

SCOPE OF THE INVENTION

This invention relates to dispensers for dispensing material onto a user's hand and, more particularly, to automated dispensers of hand cleaners which permit monitoring of use and biometrics of users.

BACKGROUND OF THE INVENTION

Automatic soap dispensers are known. Some known automatic soap dispensers can be activated by a person pushing a button with a user's hand. Other systems sense a user's hand as by with a photosensor and can dispense without the user touching the dispensers as, for example, illustrated in U.S. Pat. No. 4,938,384 to Pilolla et al issued Jul. 3, 1990, and U.S. Pat. No. 5,836,482 to Ophardt et al, issued Nov. 17, 1998.

Washing a person's hands is becoming very important in the food and health industries. In some food industries, there is a legal requirement that workers wash their hands every 20 minutes. There is also a legal requirement that the persons wash their hands after every break or upon entering a clean room as in an operating room in a hospital. These legal requirements give rise to the disadvantage that employers should monitor that people are properly washing their hands to comply with health regulations and proper safety procedures, and to be able to provide evidence of compliance with such regulations and procedures.

Systems are known where a person punches his ID code into a keypad to operate the soap dispenser. Other systems are known where magnetic cards monitor the entry of persons into clean rooms and alert the user by a warning if that person does not then use the soap dispenser. However, the present applicant has appreciated that these systems suffer the disadvantage that persons can fool these systems by activating the soap dispenser yet merely permitting the dispenser to dispense soap without the soap having to come onto the person's hands and without the person washing their hands.

Dispensers are known which provide on a surface of a dispenser a fingerprint reader for engagement by a finger or thumb of a user's hand while the user's hand is ready to receive fluid to be dispensed. The present applicant has appreciated that such dispensers suffer the disadvantage is that the fingerprint reader bed is to be contacted by the user's finger or thumb which provides a possibility for contamination of the fingerprint reader bed by one user, and the possibility of transference of the contamination to a later user contacting the fingerprint reader bed.

Palm vein identification uses an individual person's unique vein pattern to identify an individual's palm as a sensitive biometric authentication technique. Palm vein identification is known which uses an infrared sensor to capture a user's vein pattern over the palm of a hand. A typical palm reader illuminates a user's palm with infrared light and then captures an image of the palm. Since the deoxidized hemoglobin in the vein vessels absorb at least portions of the infrared light, when the infrared ray image is captured, the blood vessel pattern containing the veins is visible as a series of dark lines. Using an extracted vein pattern image, software technology is known which compares and matches the extracted vein pattern with previously recorded vein patterns of individuals. Patents teaching palm print identification include U.S. Pat. No. 4,032,889 to Nassimbene issued Jun. 28, 1977 and published U.S. patent application US 2007/0206098 published Sep. 6, 2007.

Infrared thermometers are known to measure temperature using infrared radiation emitted from an object. One basic design comprises a sensor to sense infrared energy, preferably, with a lens to focus the infrared energy on the sensor. The sensor converts the energy to an electric signal that can be displayed in units of temperature after being compensated for ambient temperature variation. Such an infrared thermometer permits temperature measurement from a distance without contact of the object to be measured such as a user's hand. Non-contact infrared thermometers are disclosed in U.S. Pat. No. 4,797,840 to Fraden, issued Jan. 10, 1989 and U.S. Pat. No. 6,129,673 to Fraden, issued Oct. 10, 2000, the disclosure of which is incorporated herein by reference.

Screening of people to determine whether or not they may have a fever and thus may be considered to be suffering from an infectious disease such as the flu can be important in many situations as, for example, to segregate ill people from healthy people at work, in health care environments, at schools, at airports and the like. However, there is not presently a simple system which assists in screening people with fever.

SUMMARY OF THE INVENTION

To at least partially overcome these disadvantageous of previously known devices, the present invention provides a dispenser, more particularly, a hand cleaner dispenser incorporating a reader for a user's hand which avoids the need for contact between the user's hand and the dispenser yet provides opportunity for the monitoring of biometrics of the user including, optionally, reading the palms of users, determining the identities of users, monitor usage, and measuring temperatures of the users.

An object of this invention is to provide an improved dispenser which can sense biometric data of a person's hand including palm print reading capability and/or hand temperature determination capability.

An object of this invention is to provide an improved dispenser for dispensing fluid onto a hand which includes a palm reader.

Another object of this invention is to provide an improved dispenser for dispensing fluid onto a hand including a thermometer to make a determination of the temperature of the hand.

In one aspect, the present invention provides a hand cleanser dispenser comprising:

an outlet disposed to dispense fluid downwardly onto an upwardly directed palm of a user's hand when the hand is within a desired proximity of the outlet below the outlet, (spaced from contact with the dispenser/outlet), a dispensing mechanism to dispense material from the outlet when the dispensing mechanism is activated, a control mechanism to activate the dispensing mechanism to dispense material from the outlet, a hand sensing mechanism to determine whether a user's hand is underneath the outlet within the desired proximity of the outlet below the outlet, a palm reader disposed to read the upwardly directed palm of the user's hand when the user's hand is below the outlet, a palm reader sensing mechanism to determine whether the palm reader has sensed a user's palm below the outlet, the control mechanism requiring as a prerequisite to activate the dispensing mechanism both the hand sensing mechanism sensing that a user's hand is within the desired proximity of the outlet below the outlet and the palm reader sensing mechanism making a determination that the palm reader has sensed a user's palm is below the outlet, the palm reader sensing a user's palm is below the outlet when the palm reader receives an image representing an image which the control mechanism recognizes as a reasonably representative of an upwardly directed palm of a user's hand.

BRIEF DESCRIPTION OF THE DRAWINGS

Further aspects and advantages will become apparent from the following description taken together with the accompanying drawings in which.

DETAILED DESCRIPTION OF THE DRAWINGS

Figure 1:
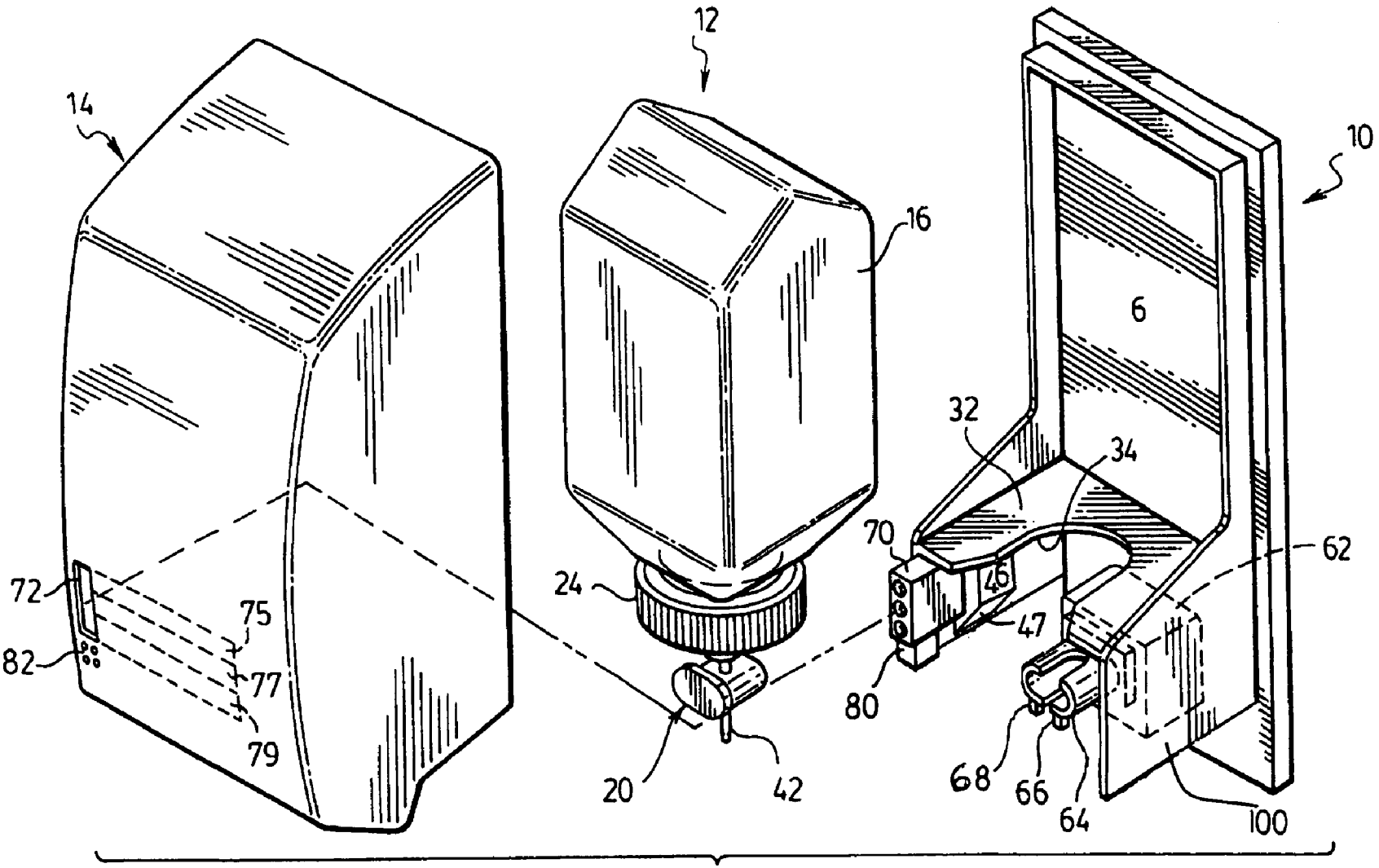
FIG. 1 is an exploded perspective view of a dispenser in accordance with a first embodiment of the present invention.

Reference is made to FIG. 1 which illustrates a soap dispenser taught by U.S. Pat. No. 5,836,482 to Ophardt et al, issued Nov. 17, 1998, the disclosure of which is incorporated herein by reference, however, which dispenser has been modified in accordance with the present invention notably to provide a palm print reader 46 or palm reader.

As taught by U.S. Pat. No. 5,836,482, the dispenser comprises a housing 10, a replaceable soap and pump unit 12 and a cover 14. The housing 10 is adapted to be mounted vertically as to a wall. The cover 14 is adapted to be coupled to the housing to permit insertion and removal of the unit 12 preferably as in a known manner with the cover 14 hingedly connected to the housing 12. The replaceable unit 12 comprises a collapsible fluid container 16 and a pump 20.

Figure 2:
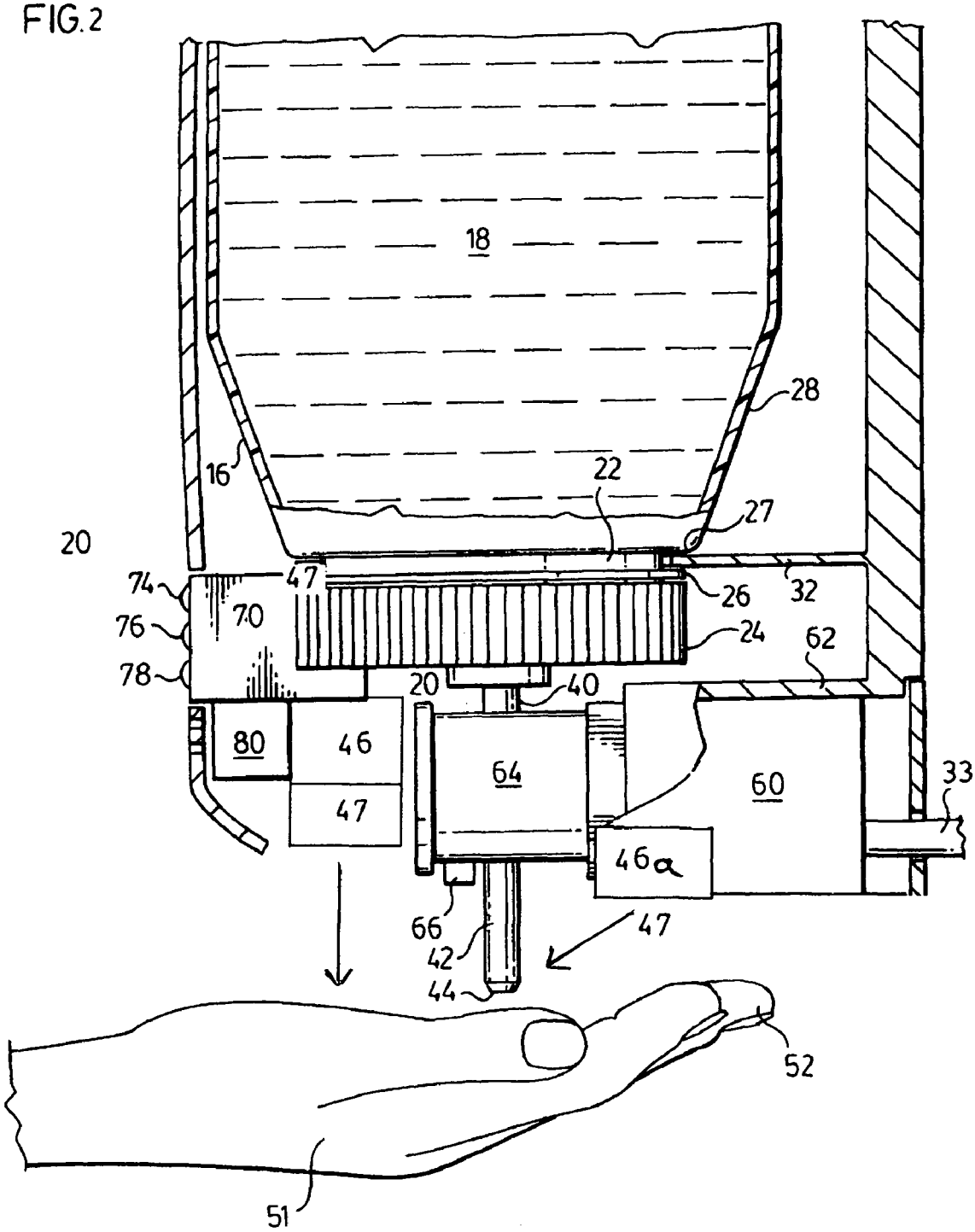
FIG. 2 is a schematic, partial cross-sectional side view of the dispenser of FIG. 1.

Reference is made to FIG. 2 which shows in cross-section the container 16 filled with fluid 18. The container 16 has a cylindrical outlet neck 22 which is externally threaded at its end to threadably receive a cap 24. The neck 22 has a radially outwardly extending flange 26 disposed closely under a radially outwardly extending portion 27 of the wall 28 of the container so as to present a radially extending support slot therebetween. The housing 10 has a horizontally extending support plate 32 with a forwardly open U-shaped slot 34 therein sized to be complementary to the support slot such that the support plate 32 can be received in the support slot and support the weight of the container 16 and locate the container in a desired position.

The cap 24 opens into a feed tube 40. Fluid is conducted via feed tube 40 to pump 20 and then from pump 20 via an exit tube 42 to out a dispensing outlet 44.

A motor 60 is mounted in a motor casing 62 in the housing 10 carrying a forwardly opening socket 64 which is sized to removably receive the pump 20 therein for operative coupling of the motor 60 to drive the pump 20.

A control mechanism is provided to control operation of the dispenser.

The control mechanism includes at least one reader 46.

In FIG. 1, the housing 10 has two vertical side plates 100. A forward palm reader 46 is mounted to one of the side walls 100 and disposed such that a scanning surface 47 of the reader 46 is directed at an angle downwardly so as to view a user's hand located centrally underneath the outlet 44. As seen in FIG. 2, the forward reader 46 is disposed in front of the outlet 44 and advantageously located so as, for example, to scan the upwardly directed palm of the user's hand 51. FIG. 2 also shows a second reader **46*a* as located under the motor casing 62 in the housing 10 and directed to read the upwardly directed palm of the user's hand 51 disposed forwardly and rearwardly thereof. Either one or both of the readers 46 or 46*a* may be provided. The location of the second reader 46*a* is rearward of the nozzle 44 and may, for example, on taking an image of the palm of the hand, have portions of the hand shielded by the nozzle 44, however, this is not considered a particular disadvantage and adequate information as, for example, to determine the temperature of a hand or for identification of the palm veins of a user's hand, may be provided whether or not the palm reader 46** may not have an unobstructed view of the palm.

Figure 13:
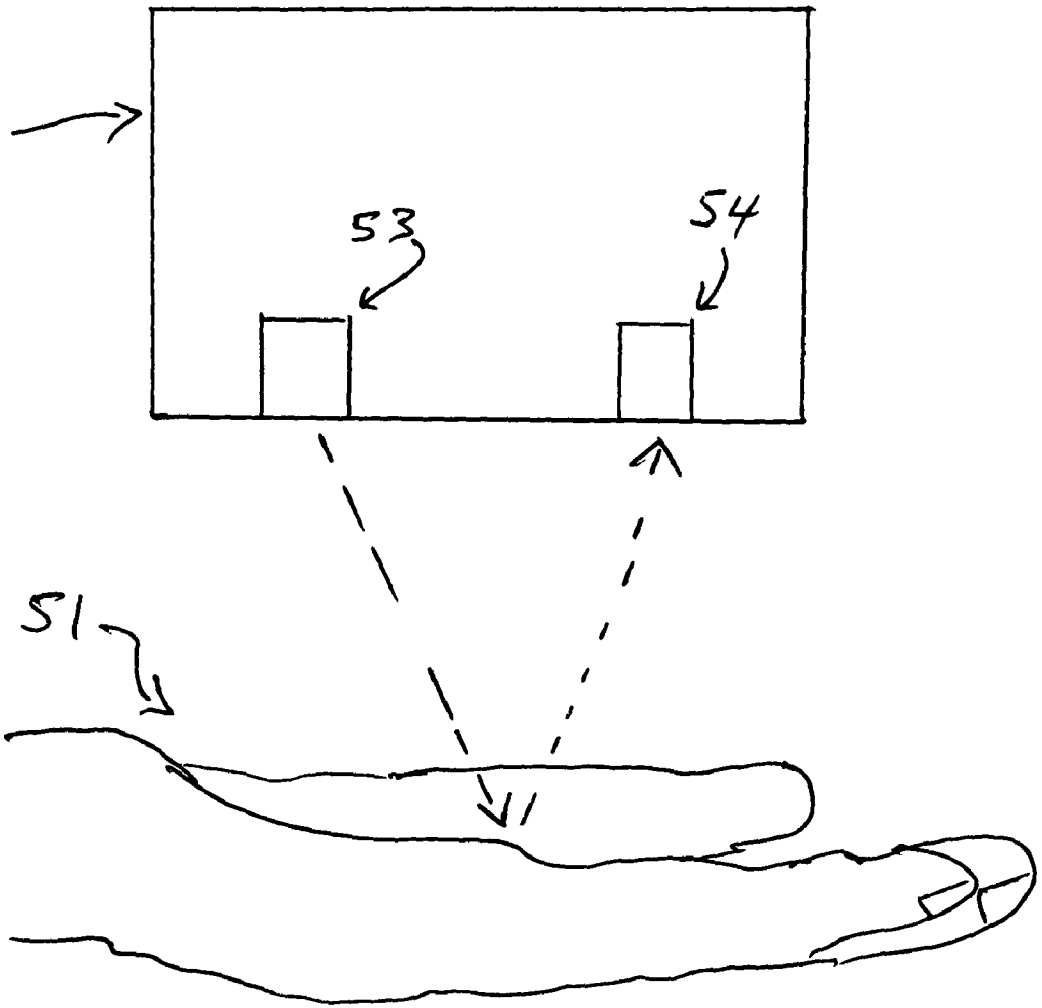
FIG. 13 is a schematic side view of a preferred reader disposed above a portion of a user's palm in accordance with the preferred embodiment of the present invention

The reader 46 may preferably include a palm reader which captures an infrared image of the user's palm. As a palm reader, the reader 46 preferably includes both an infrared emitter 53 and infrared sensor 54 such as is schematically shown in FIG. 13. The infrared emitter 53 illuminates the user's palm with infrared light as in a single flash and the sensor 54 captures the infrared image of light reflected from the palm of the hand. The sensor 54 may be a single sensor or plurality of sensors. The reader 46 preferably has the capability to measure the position, orientation of the hand and palm relative to the sensor 54 as well as movement of the hand and palm relative to the sensor 54.

The reader may preferably include a thermometer for calculating the temperature of the palm of the hand. The thermometer may preferably utilize the infrared sensor 54 to sense infrared energy emitted by the palm of the hand and based on various calculations including the ambient temperature can estimate the temperature of the palm of the hand. The estimated temperature of the palm of the hand can be used to approximate whether or not any user may have a temperature which indicates that the user may be ill. Even though the non-contact infrared thermometer may not be able to provide an accurate determination of a user's temperature, the temperature determined can be used as an initial screening test towards identifying persons who might be considered at risk of having a higher than normal temperature and which could then be subjected to a subsequent test.

Insofar as the dispenser is to include an infrared thermometer, the infrared thermometer could provide a signal which indicates when any particular user may be suspected of having a temperature above a preset threshold. The signal could, for example, be an audible sound or light as from the dispenser itself or, alternatively, could provide some means or signal of alerting a security personnel proximate the dispenser who can then segregate the person and possibly subject them to a more precise examination including possibly a more accurate temperature taking process. Non-contact infrared thermometers are commercially available which are battery operated. Such an infrared thermometer can be incorporated into a dispenser of soap or other fluids for washing a user's hand as may be provided, for example, in washrooms, at access points to hospitals, at access points to schools, airports and other areas. The dispensers for dispensing hand cleaning fluids may preferably be touchless and automatic in which case control systems and power sources for the dispenser may be combined with control systems and power sources for the infrared thermometer, however, this is not necessary and the control systems and power source for each may be separate. The infrared thermometer may also be provided in a manually operated dispenser such as those, for example, disclosed in U.S. Pat. No. 6,409,050 to Ophardt, issued Jun. 25, 2002, U.S. Pat. No. 7,367,477 to Ophardt, issued May 6, 2008 and U.S. Pat. No. 7,270,250 to Jones, issued Sep. 18, 2007. On manual engagement of a lever member for manual dispensing of product, a battery powered infrared thermometer may be activated to sense a hand below the dispensing outlet and, in the event the temperature is above a threshold temperature, to emit a signal or alarm.

Figure 9:
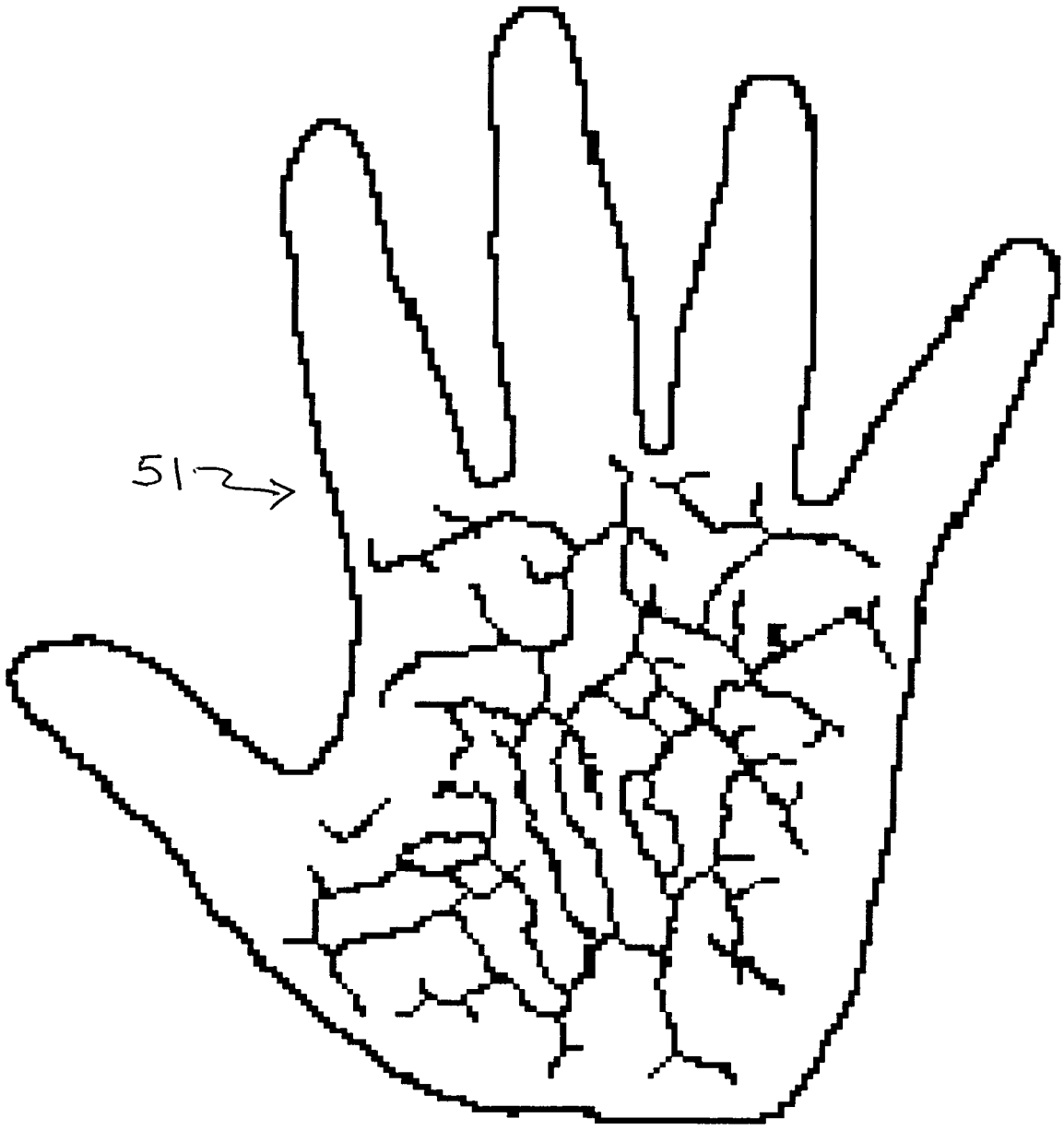
FIG. 9 is a schematic extracted vein image from a palm reader.

As part of the control system for the dispenser, computer software is preferably provided complementary to the sensors to provide desired functionality. Such functionality can include determining a temperature of the palm, determining the location of, orientation of and/or relative movement of the hand and palm. The software can, for example, create an extracted vein image of the palm which has been sensed regardless of the position and movement of the palm. FIG. 9 illustrates a schematic extracted vein pattern image from such a palm reader. Preferably, the software is preferably capable of determining whether or not any extracted vein image comprises a reasonable representation of a vein pattern for a human palm and, as well, the software is capable of matching the extracted vein pattern with vein patterns which have been previously recorded in the database as by suitable pattern matching methods which are known.

One preferred palm reader with an associated palm vein authentication system is sold by Fujitsu Computer Products of America Inc. under the trade mark PALMSECURE and provides a small sized sensor, for example, of about 1.3 inches square by 1 inch high (35 mm square by 27 mm high) together with complementary software.

FIG. 2 shows the readers 46 and 46*a* and outlet 44 located relative to each other with the user's hand 51 located underneath the readers 46 and 46*a* and the outlet 44 in a desired position spaced from both the readers 46 and 46*a* and the outlet 44. The user's hand 51 is located under the outlet 44 so that material dispensed from the outlet 44 will necessarily engage the user's hand 51.

The dispenser may be controlled by the control mechanism to operate in many different manners. In one simplified manner of operation, a user places his hand under the outlet 44 and the readers 46 and/or 46*a* will attempt to read the palm and on one palm reader determining that a palm print has successfully been read, the pump 20 is activated to dispense a dose of fluid. Preferably, the fluid would not be dispensed until a palm print is successfully read.

The reader 46 or 46*a* preferably is one which can successfully read a palm within a first short period of time, i.e. preferably less that about ⅕ of a second. Preferably, the pump can dispense a substantial portion of the dose of material, i.e. between 40% and 100% of a desired dose in a short period of time, preferably less than about one second. With the palm reader operation and dispensing of material operation carried out in such short periods of time, there is a high probability that the dispensed material necessarily is dispensed onto the user's hand, in that insufficient time typically passes for a user to withdraw his hand from under the outlet 44 after his palm print has been read and before material is dispensed onto the hand.

Rather than merely rely on the mere fact that a palm print has been read and that the speed of reading and dispensing is such that material must have been dispensed onto a user's hand, a mechanism may be provided to more positively ensure that the palm and/or hand is located in positions that the material when dispensed will necessarily engage the hand, that is, is within a desired proximity of the other. In this regard, the reader 46 preferably includes at least one proximity sensor which will sense the presence of the user's hand 51 under the reader 46 and the exit tube 42 and, particularly, before and during such time that material is being dispensed.

The reader 46 preferably itself comprises not only a mechanism to read a palm print but also a mechanism which provides other functions such as sensing whether a hand is located under the outlet 44 and the reader 46 within a desired proximity of the outlet 44 senses the relative orientation of the palm and hand, senses the movement of the hand and senses the temperature of the hand. The sensors for these functions may alternatively be provided separately as indicated schematically as 66 and 68 separate from the reader 46. For example, separate proximity sensor mechanisms are well known. Preferred separate sensors include thermal sensors which will sense the heat from a user's hand, motion sensors which will sense motion of a person's hand and photo detection sensors which will sense reflected signals from a signal emitting source provided on the dispenser. As one example, socket 64 can carry as element 66 an emitter element 66 and as element 68 a sensor 68, a light emitting diode to transmit a pulse of infrared energy at predetermined timed intervals downwardly from the housing with element 68 as a corresponding photo receiver mounted along side the photo emitter element 66 but shielded therefrom such that energy of a predetermined configuration may be emitted by the diode element 66 and when reflected off a user's hand placed beneath the dispenser will be received by the receiver element 68 to signal the presence of a user's hand. Such a system is described, for example, in U.S. Pat. No. 4,967,935 to Celest, issued Nov. 6, 1990.

The proximity sensors can be used to sense the location of the hand and/or finger before reading a palm print, while reading a palm print and/or after reading a palm print. The sensors are useful before reading a palm print to assist in providing instructions to a user to locate his hand. During reading, the sensors are useful to provide instructions to hold the hand proximate the reader. After reading a palm print, the sensors are useful to positively ensure that during the period of time that material is dispensed that the material dispensed will necessarily engage the hand because the user's hand or fingers are sensed to be in desired locations.

The dispenser can be controlled using at least one sensor to sense the proximity of the user's hand within a desired proximity to the outlet 44 before or during the time that material is being dispensed. In FIGS. 1 and 2, sensor 68 can sense the proximity of the hand during the period that material is being dispensed, i.e. while the pump 20 is activated. The control mechanism can then generate a signal of positive dispensing onto the user's hand.

Alternatively, one or more of the elements 66 and 8 may comprise a non-contact thermometer to sense the temperature of the hand and/or motion sensors to sense movement of the hand.

A signal mechanism is preferably provided to provide signals and feedback to a person using the dispenser. In FIGS. 1 and 2, a visual signal device 70 is secured to the housing 10 and is visible through a window 72 in the cover 14. The visual signal device 70 is provided with an array of three signal lamps 74, 76 and 78 which can provide various signals to a user and preferably are capable of being unlit or showing different colours such as red or green. On the cover 14, adjacent the location that each of the lamps appear in the window 72, written indicia may be provided in boxes 75, 77 and 79 to interpret the lamp's signals.

FIGS. 1 and 2 also show an audio signal device or loud speaker 80 to pass audio signals such as pre-recorded language signals and musical notes, tones, buzzes and alarms. The sound may pass through the cover 14 as by an array of holes 82.

The sensors shown in the first embodiment of FIGS. 1 and 2 include the palm reader 46 and the elements 66 and 68. The sensors may be used in combination to provide various signals. For example, with sensor 68 sensing a hand in a desired proximity to the outlet 44 or sensing a hand with a temperature above a threshold temperature, the control mechanism could give a suitable signal, for example, whether advising the user that the hand is in a correct position or advising of a high temperature condition.

The control mechanism can over time obtain information from the reader, the various sensors and the pump and recognize various situations in which various signals may be generated, communicated and/or recorded.

For example, in one operation, on a person initially placing the hand under the dispenser, one of the reader and the sensors can sense the hand and/or fingers and give a first signal to hold or move the hand. Such a request could be continued either until the location of the hand is acceptable when a second signal of hold could be given or until the temperature of the palm is taken and/or the palm print is read. Similarly, after the palm print is read, a signal of hold could be given. After material is dispensed and the sensors have sensed that the hand/palm were in the desired position while material was dispensed, a third signal of successful dispensing could be given with instructions to remove hand. These first, second and third signals could be communicated by each of lamps 74, 76 and 78 becoming lit beside suitable written notices displayed on the cover in boxes 75, 77 and 79. Each signal could also be accompanied by an audio message.

As in U.S. Pat. No. 5,836,482, various arrangements can be made to monitor that there is fluid 18 in the container, that the pump is operative, that the pump is supplied with power, and/or that the dispenser systems are generally functional, and these monitoring arrangements could be used to deduce whether material is actually dispensed.

Figure 3:
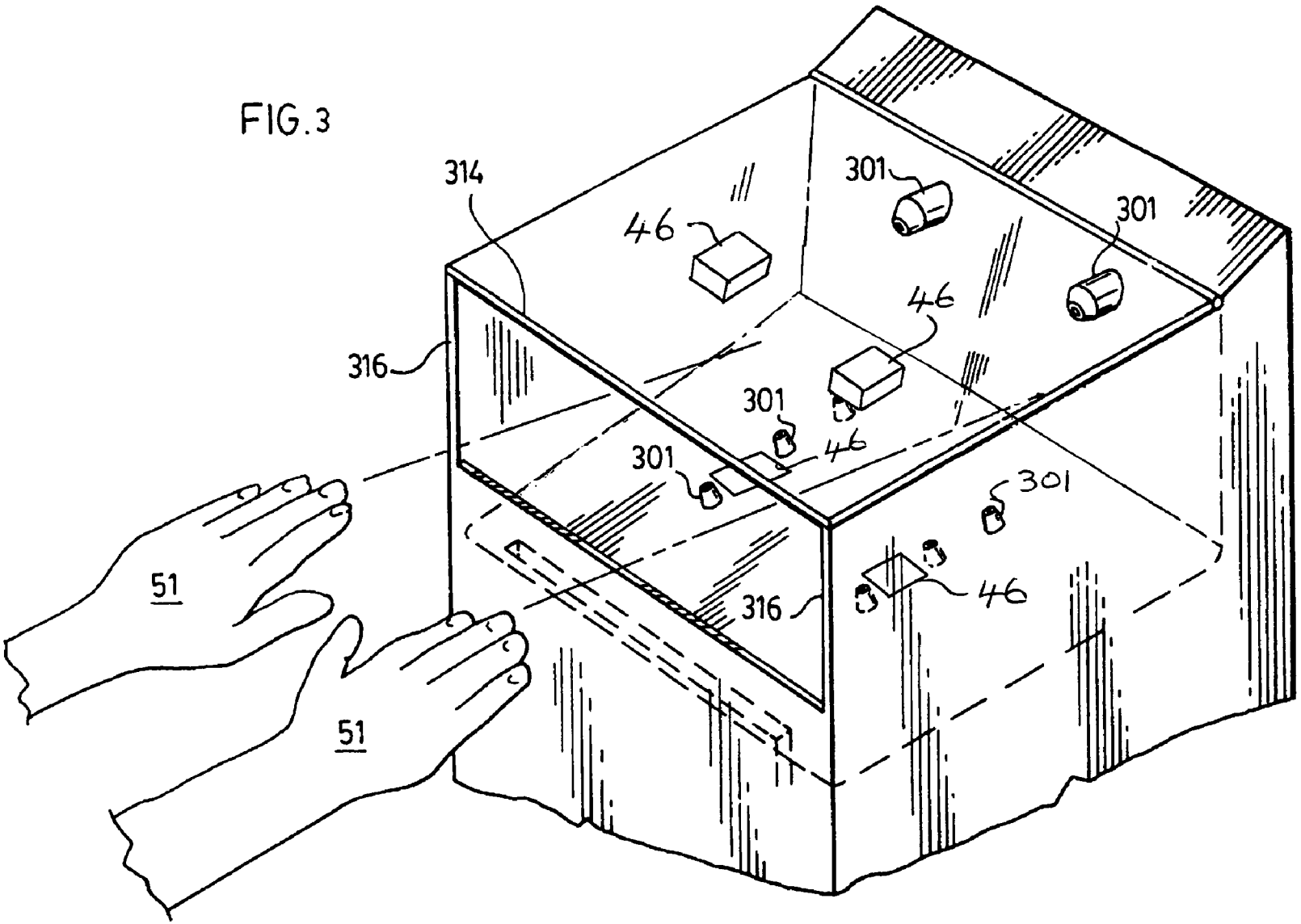
FIG. 3 is a perspective view of a dispenser in accordance with a second embodiment of the present invention.
Figure 4:
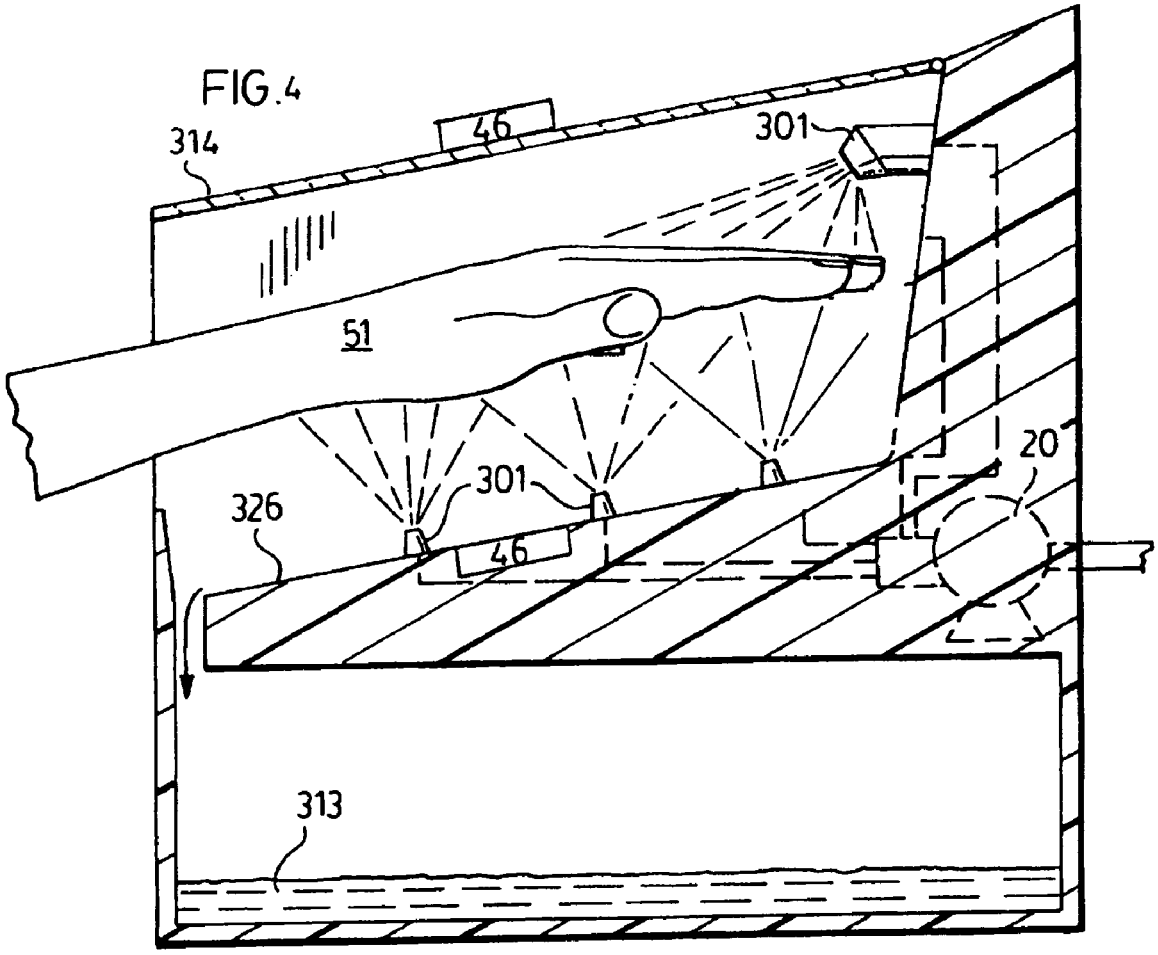
FIG. 4 is a schematic, partially cross-sectional side view of the dispenser of FIG. 3 showing dispensing onto a person's hands.

Reference is made to FIGS. 3 and 4 which shows a second embodiment of a dispenser in accordance with the present invention. In FIG. 3, the dispenser generally indicated 300 carries an internal pump 20 connected to various outlets or nozzles 301 adapted to spray material such as an alcohol based disinfectant onto the palm and the back of a user's hand 51. The second embodiment is adapted to receive both hands at once. Various nozzles 301 are provided to direct sprayed liquid onto the front and back of a user's hands as shown in FIG. 4. A sump 313 may be provided to collect drippings and overspray. The dispenser is provided with a shroud comprising transparent top 314 and sides 316 to contain overspray and limit a user to holding his arms in a desired orientation. Four readers 46 are shown supported either below the hands on the catch surface 326 or above the hands on the top 314. Of these, two readers 46 are provided for each hand such that a user's palm will be sensed whether the palms are directed upwardly or downwardly. As seen, the top and bottom surfaces of the hand are accessible to be sprayed, preferably with the hands extended generally horizontally as shown. Only one reader is required per hand.

Figure 5:
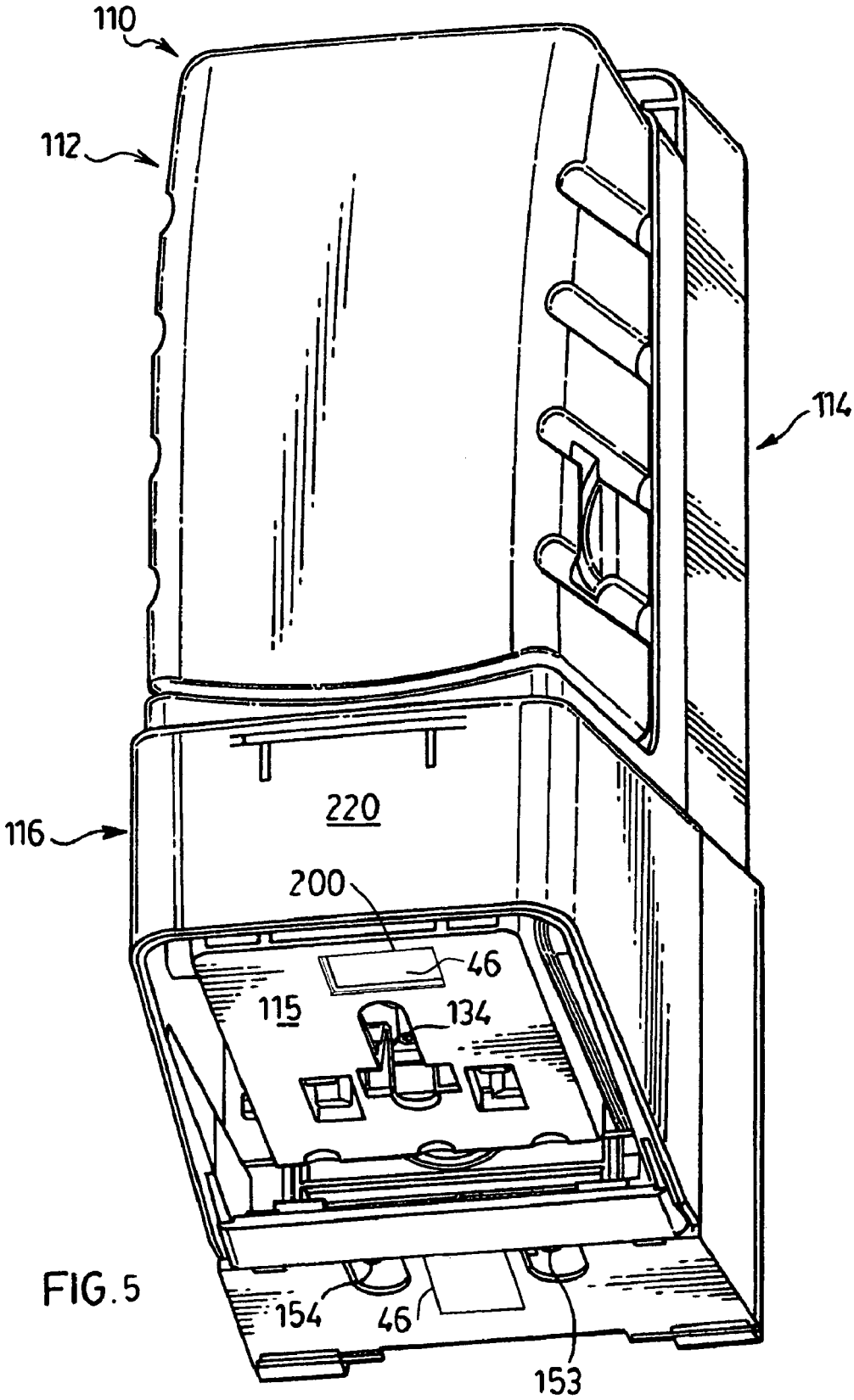
FIG. 5 is a perspective view of a dispenser in accordance with a third embodiment of the present invention.
Figure 6:
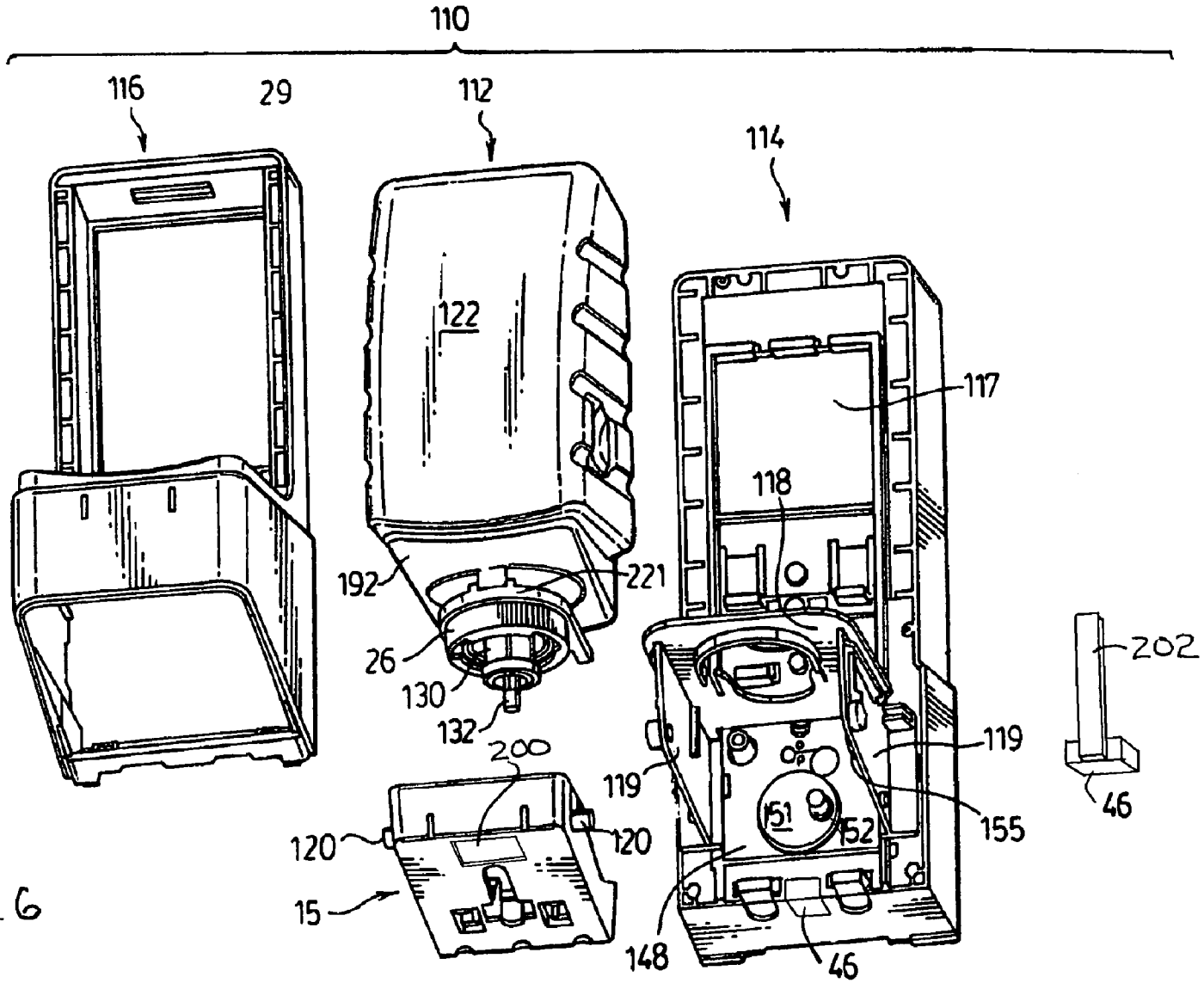
FIG. 6 is a perspective exploded view of the dispenser shown in FIG. 5.
Figure 7:
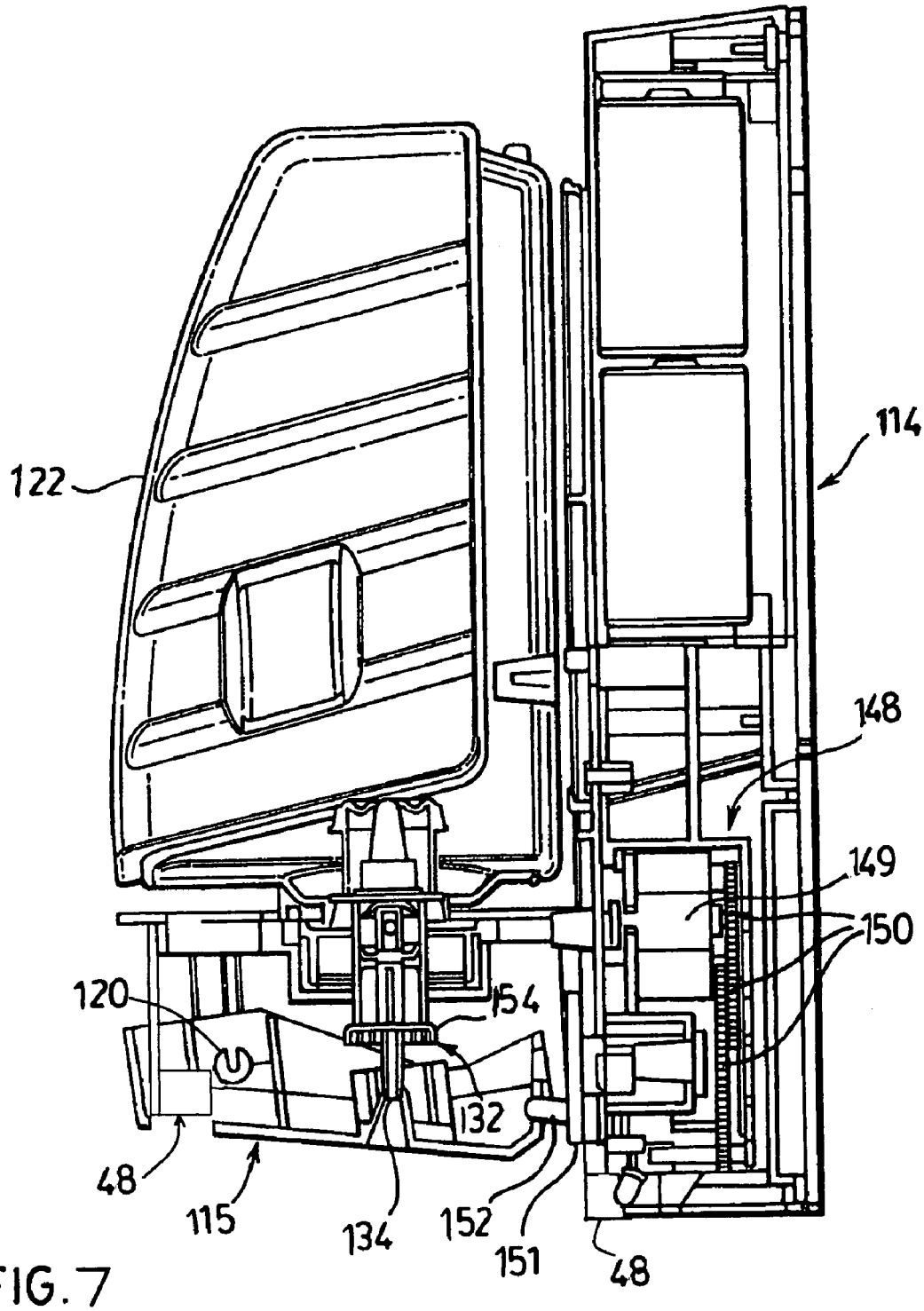
FIG. 7 is a schematic cross-sectional view of the assembled dispenser shown in FIG. 5.
Figure 8:
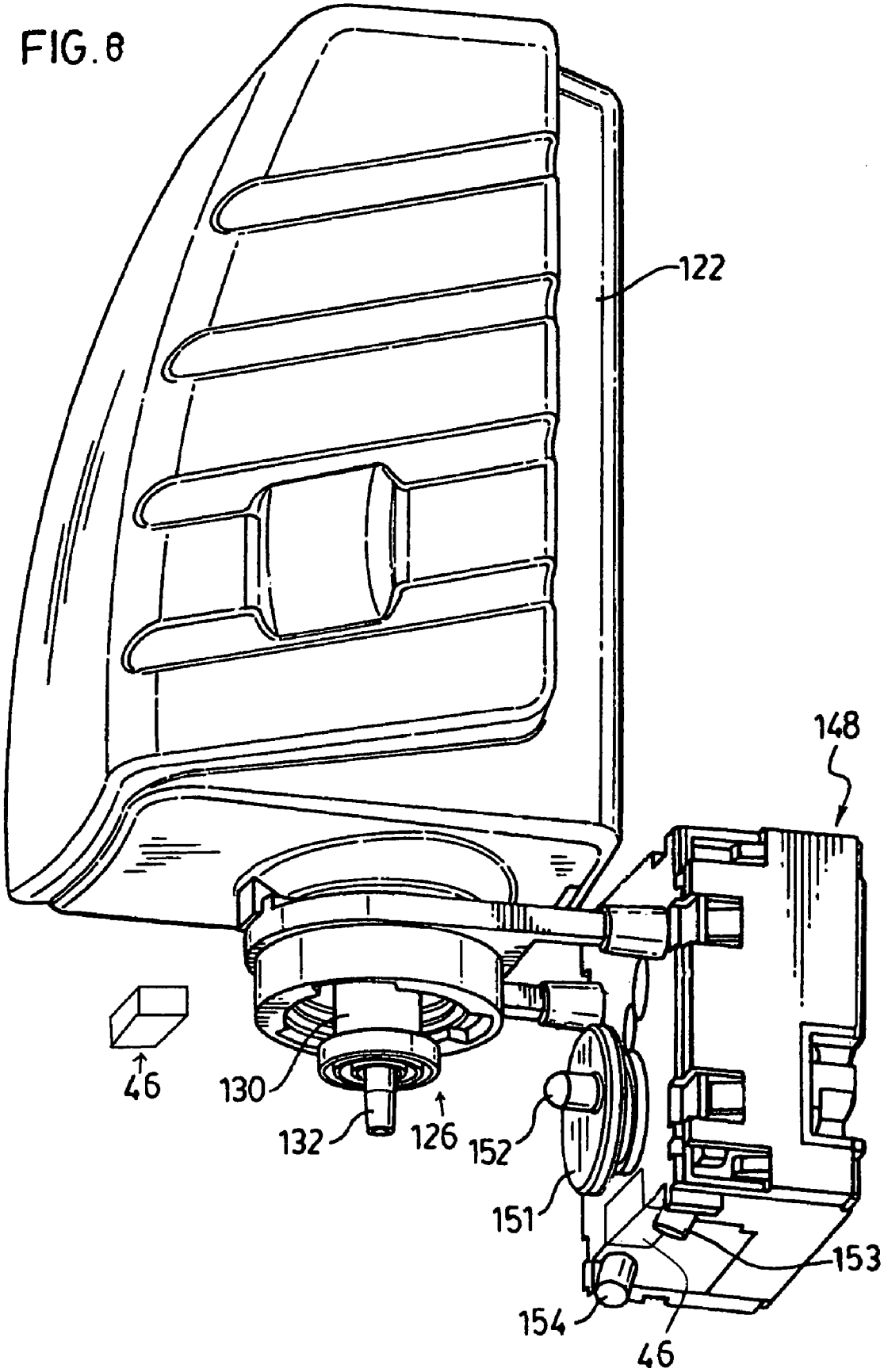
FIG. 8 is a pictorial view showing selected elements of the dispenser of FIG. 5 together with a user's hand.

Reference is made to FIGS. 5 to 8 which illustrate a third embodiment of a dispenser in accordance with the present invention and which is similar in many respects to the dispenser disclosed in U.S. patent publication US 2008/0308574, published Dec. 18, 2008, the disclosure of which is incorporated herein by reference. FIG. 5 illustrates a dispenser assembly 110 which, as seen in FIG. 2, includes a removable reservoir assembly 112 adapted to be secured to a housing formed by a combination of a back plate assembly 114, a presser member 115 and a shroud 116. The back plate assembly 114 has a generally forwardly directed face plate 117 from which a horizontally disposed support plate 18 extends forwardly supported by two side plates 119. The presser member 115 is pivotally mounted to the back plate assembly 114 between the two side plates with stub axles 120 received in journalled bores in each side of the side plates. The housing is completed by the shroud 116 being coupled to the back plate assembly 114 to substantially enclose the support plate and the presser member 115. The reservoir assembly 112 is adapted to removably couple to the coupled housing by vertical movement downwardly onto the support plate 118 and then move rearwardly. The reservoir assembly 112 comprises a reservoir bottle 122 and a pump assembly 130 comprising a piston chamber-forming member and a piston 132 reciprocally movable coaxially to dispense fluid out of the lower end of the piston 132. In an assembled dispenser 110, the piston 132 is coupled to the presser member 115. As seen in FIG. 8, an activation unit 148 is provided within the back plate assembly 114. The activation unit includes a drive wheel 151 with a cam post 152 to engage the presser member 115 and pivot the presser member upwardly or downwardly about the stub axles 20 with rotation of the drive wheel 51 so as to dispense fluid from the piston 32. As seen in FIG. 4, a motor and various gearings 50 as driven by batteries carried in the back plate assembly 114 rotate the drive wheel 51 as controlled by a control circuit, not shown. FIG. 8 best shows the alternative positions for locations of sensors 153 and 154 and two readers 46 and **46*a*. As seen in FIG. 8, sensors 153 and 154 can comprise, respectively, location sensors to locate the position of a user's hand with, for example, one being an emitter and the other being a receiver of reflected light to determine the presence of a user's hand under the dispenser. A first reader 46 is shown disposed forward of the piston outlet 32 which forward reader is disposed substantially directly above the palm of a user albeit the reader 46 may be required to be directed slightly rearwardly. FIG. 8 also shows a second reader 46*a* disposed between the sensors 53 and 54 and conveniently located within the activation unit 148. The activation unit 148 preferably contains all the electronic and electrical components for the dispenser other than the batteries and, therefore, the reader 46*a* within the activation unit 148 may conveniently be connected to the remainder of the electronic circuitry. In contrast, the reader 46 disposed forward of the outlet 132 may be connected to the activation unit 148 as by suitable wiring shown. As may best be seen in FIG. 5, a window 200 is provided through the presser member 115 by which the forward reader 46 may view the upwardly turned palm of a hand. As seen in FIG. 6, the forward reader 46 may be supported by a rigid support strap 202 so as to hang downwardly from the support plate 118 as also seen in FIG. 7**.

A palm print reader 46 for use in the reader is preferably of a commercially available type such as commercially available from Fujitsu Computer Products of America, Inc., such as sold under the trade name PALMSECURE and comprising small palm print readers and supporting software. Such palm print readers incorporate a device such as a camera or scanner to capture an image of a palm print. Software including algorithms convert the image into a unique map which is encrypted and can be stored. The palm prints of employees can be stored in a database as such encoded map and any palm print read cross-referenced to identify the user.

The reader 46 may be connected to a conventional commercially available computer, as by hard wiring, WIFI or other connections. The entire control system for the dispenser including its sensors, their readings, signals generated and general operation data may be controlled by a computer. With data recorded in the computer as to the identification of users using the dispensers by means of a palm print, use of the dispensers by employees can be monitored.

Rather than have a dispenser wired to a computer capable of handling all computer manipulations desired, it is possible to provide the dispenser with its own microprocessing capabilities capable of controlling its operations and of recording essential data about a palm print read. For example, the dispenser might be able to capture an image of a palm print and/or convert it into an encrypted data format together with other data such as time and whether the hand was kept under the outlet when fluid was dispensed. This data could be stored in a memory device in the dispenser. Periodically, the dispenser could be connected to a reading device to download the stored data for delivery to and processing by a more powerful conventional computer.

A successful reading of a palm print to activate dispensing could in one aspect record an image of the print in some form and, in another aspect, provide positive identification of the user. Where there is positive identification of a user as by comparison of the print read with stored prints, the opportunity arises for individualized action and/or immediate feedback to that user.

The dispenser could be adapted to be battery powered as in the manner taught by U.S. Pat. No. 5,836,482, however, may be powered by permanent power systems which may provide low voltage direct power to provide safety and compatibility with needs of powering the palm print reader and other computer control systems for the dispenser. A conduit may also be provided for hard connection of the dispenser to a remote computer. A plurality of similar dispensers could be connected to one computer or networked.

Operation of the dispenser of FIGS. 1 and 2 can be controlled so as to not require the reading of a palm print or confirmation of reading of a palm print or a palm temperature reading to activate dispensing of fluid. For example, on the reader 46 or sensor 68, sensing the proximity of a hand within a desired first proximity for a first period of time say for a palm print to be recorded or a temperature to be taken, whether or not the palm print reader is present or operative or can signal that a print has been read and whether or not a temperature can be measured, the pump may be activated. While the pump is activated, the sensors can monitor the proximity of the hand within a desired second proximity for a second desired period of time, say one to two seconds following the first period of time. A user would be unaware that a record of his palm print may or may not have been taken or that his temperature may or may not have been taken. Avoiding the need to have the dispenser have the capability of signalling whether it has captured an adequate palm image or temperature reading avoids a need for increased size of image or data processing capacity in the dispenser as may be advantageous where the dispenser will only periodically have its data downloaded for further processing.

Preferably, in accordance with the present invention, the dispenser provides an arrangement and sequence for recording the image of a user's palm carefully the first time a user may use the dispenser. Thus, in accordance with the present invention, when a dispenser may take an image of a user's palm and not find in its database another comparable image, the dispenser may take multiple images of the same palm to provide a composite image for storage and/or may provide instruction to the user requesting the user, for example, to hold their hand under the dispenser again as, for example, to permit additional images to be taken and stored.

In accordance with the present invention, the palm reader control system preferably has the capability to make a determination whether or not the palm reader has sensed a user's palm below the outlet. For example, the control mechanism may include a palm reader sensing mechanism which provides minimum characteristics of an image against which a comparison may be made for making a determination that either the palm reader has sensed a user's palm or the palm reader has not sensed a user's palm. Whether or not any image of a user's palm may be recognized, preferably, the control mechanism requires as a prerequisite to activate the dispensing mechanism that a palm reader sensing mechanism has made a determination that the palm reader has sensed a user's palm is below the outlet as contrasted with sensing something which is not a user's palm such as, for example, the back or side of a user's hand or some other object.

Figure 10:
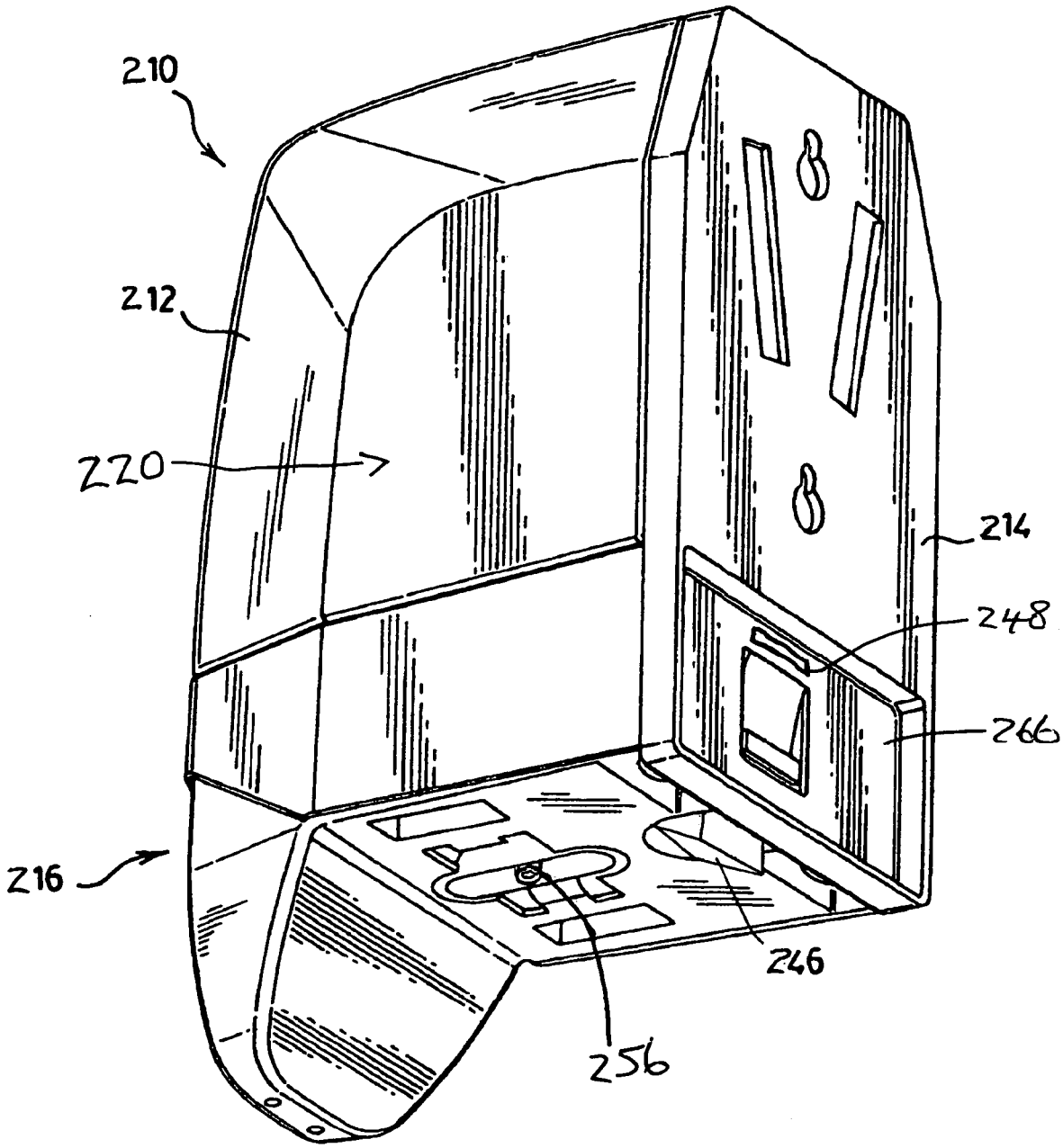
FIG. 10 is a pictorial view of a manual soap dispenser in accordance with the third embodiment of the present invention.
Figure 11:
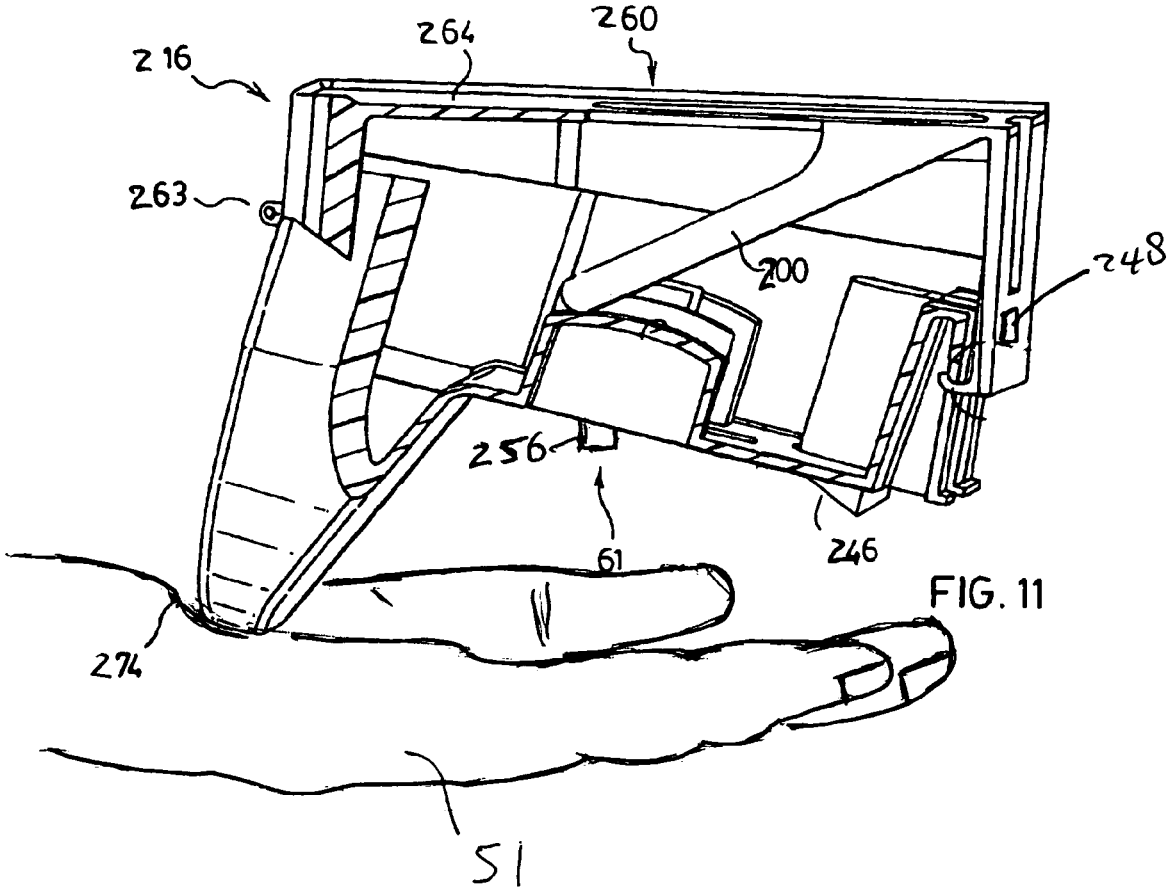
FIG. 11 is a schematic partially sectioned cross-section view of a lower portion of the dispenser shown in FIG. 10.

Reference is made to FIG. 10 which illustrates a manual dispenser for hand soap substantially the same as that disclosed in U.S. Pat. No. 7,270,250 to Jones, issued Sep. 18, 2007, the disclosure of which is incorporated herein by reference. The dispenser of FIG. 10 is adapted to be mounted to a wall via a wall plate 214. The dispenser 210 carries a bottle 220 from which fluid is to be dispensed outwardly out of a discharge outlet 256 of a piston pump on manual activation of activator member 216 to pivot the actuator member 216 relative to the remainder of the dispenser so as to slide a piston of the piston pump thereby dispensing from the outlet 256 fluid from the bottle. As schematically shown in side view in FIG. 11, the actuator member 216 comprises as a support member 260 and a presser member 261 pivotally coupled together for pivoting about a horizontal axis 262 by a living hinge 263 which is a thin plate of plastic which bridges between the support member 260 and the presser member 261. A spring member 200 is provided on the support member 260 extending from the support member 260 to the presser member 261 and biasing the presser member 261 to pivot about the pivot axis downwardly to the fully extended position shown in FIG. 11. In use, a user engages the hand lever 274 on the presser member 261 with the heel of the hand 51 locating the hand underneath the nozzle outlet 57. As shown in both FIGS. 10 and 11, the presser member 61 carries a reader 246 preferably in the form of a self-contained battery operated infrared thermometer. The self-contained thermometer may best be seen in FIG. 12 as a separate unit 247 adapted to be received as in a snap-fit relation inside a vertically extending semi-cylindrical wall 213 formed in the back wall 271 of the presser member 261. As a mechanism to activate the temperature sensor in the reader 246, the reader 246 may carry internally proximate its upper end 211*a* sensor sensitive to a permanent magnet 248 which is carried on the rear wall 266 of the support member 260. When in an extended rest position as shown in FIG. 11, there is no movement between the magnet 248 and the reader 246. However, on initial movement of the presser member 261 by the hand of a user, relative movement of the magnet 248 is sensed which then activates the reader 246, so as to initiate a temperature measurement as by sensing infrared radiation on the fingers and palm of the user's hand under the dispenser via the rectangular sensing window which is directed downwardly on the reader 246. With manual movement of the presser member 261 upwardly, fluid is dispensed via the outlet 256 of the pump onto the hand of the user for use. In a simple embodiment, the self-contained thermometer 246 may emit a high pitched beep or series of beeps if the temperature sensing mechanism senses a temperature above a predetermined threshold.

In the first two preferred embodiments of FIGS. 1 to 8, the reader 46 may preferably have the capability of sensing movement of the hand as, for example, relative to the sensor 54 shown in FIG. 9. In one preferred manner of use, the reader 46 may be programmed such that it can be determined if a user's hand is moved deliberately sideways from a position underneath the outlet to a position beside the outlet and then to a position back underneath the outlet. Such a movement of the hand of the user could be used in a manner that the user could signal to the dispenser that an additional allotment of fluid is desired to be dispensed. For example, typically, on a user placing a hand underneath the dispenser, the dispenser will cause a single allotment of fluid to be dispensed. Typically, the dispenser will be programmed such that if a hand is held under the outlet, only one allotment of fluid will be dispensed. As well, the control mechanism typically has a time delay such that it will not dispense a second allotment of fluid until a time has passed after the first allotment has been dispensed. Thus, a person desiring to obtain a second allotment of fluid on their hand may typically need to wait a period of time for a second allotment beyond that which is desired. In accordance with this preferred manner of use, once an allotment of fluid has been dispensed onto the user's hand, if the reader 46 or the sensor 68 senses that the user's hand has been moved horizontally to one side and then back underneath the outlet, the dispenser will promptly dispense a further allotment of fluid. This can be particularly advantageous, for example, in medical situations where it may be desired that small allotments of say, 1 ml of fluid is dispensed and promptly rubbed into a user's hand and the user knows that an additional one or more allotments of fluid are desired. In this case, the user can wave his hand to one side or the other in order to command the dispenser to dispense a further allotment of fluid as desired. A person using the dispenser would need to be alerted as to the opportunity to move his hand to the side and back in order to obtain dispensings of a separate allotment. With the reader 46 being able to sense the relative position and orientation of a hand and movement of the hand relative to the outlet, it is possible to control the dispenser so as to permit dispensing of additional allotments of fluid by specific relative movement of the hand which preferably is a sideways movement or waving of the hand. Of course, other movements could be arranged such as a rotation of the hand so the back shows and then shows the palm or some such other movement.

Figure 12:
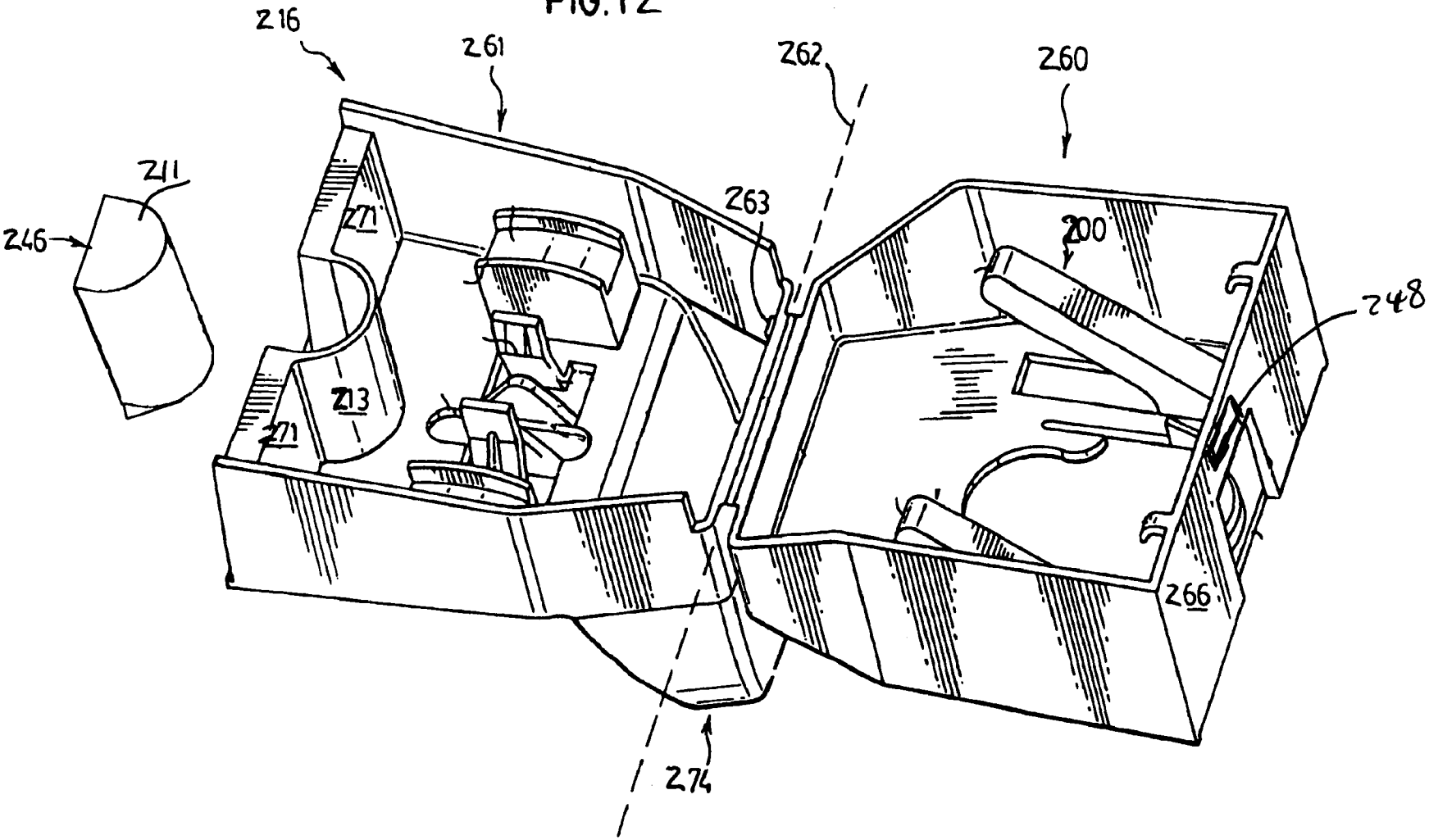
FIG. 12 is a pictorial exploded view of the actuator member 16 in an unfolded position together with its reader.

The self-contained electronic thermometer 246 shown in the third embodiment of FIGS. 10 to 12 may have various other mechanisms for signalling that temperature exceeding a threshold temperature has been located. For example, the electronic reader 246 could include a Wi-Fi transmitter as, for example, to transmit a simple signal. This signal might be received by a receiver held by a security personnel. The signal might also be received by a separate camera or security system to record an image of the person or otherwise activate some form of more substantial alarm.

In accordance with the present invention, where the non-contact thermometer is desired to read the temperature of a user's hand, it is preferred that the temperature of a user's hand be taken from a surface of the user's hand before fluid might be dispensed onto that surface of the user's hand. This may be accomplished in a number of ways. Firstly, the temperature may be sensed over an area of the user's hand on which fluid is not dispensed as, for example, over the fingers or other portions of the hand where fluid is not expected to be dispensed initially. Alternatively, the temperature may be sensed over other portions of the hand as, for example, on the back of the hand and, in this regard, for example, if the palm of a user's hand is directed upwardly towards an outlet to dispense fluid, the temperature sensor could be located to sense the back of the hand.

While the invention has been described with reference to preferred embodiments, many variations and modifications will now occur to persons skilled in the art. For a definition of the invention, reference is made to the appended claims.

I claim:

1. A method of dispensing material onto a person's hand comprising:

placing a user's hand such that an upwardly directed palm of the user's hand is disposed under a fluid outlet from which fluid is to be dispensed, sensing with a hand sensor that the palm of the user's hand is underneath the outlet within a desired proximity of the outlet, after sensing with the hand sensor that the hand is proximate the outlet in the desired proximity activating a palm reader disposed to read the upwardly directed palm of the user's hand when the user's hand is below the outlet to determine whether the palm reader senses a user's palm below the outlet, and if the palm reader senses a user's palm is below the outlet by the palm reader receiving an image representing an image which a control mechanism recognizes as reasonably representative of an upwardly directed palm of a user's hand, then dispensing material from the outlet for a period of time in a manner that the material will engage the palm of the user's hand underneath the outlet within the desired proximity of the outlet, including determining whether a user's hand remains underneath the outlet as sensed by the hand sensor for at least part of a period of time during which the material is dispensed, activating the palm reader to determine whether the palm reader senses a user's palm below the outlet with the dispensed material on the upwardly directed palm by receiving an image representing an image which the control mechanism recognizes as reasonably representative of an image of an upwardly directed palm of a user's hand yet with portions of the image replaced by an image the control mechanism recognizes as reasonably representative of dispensed material on the upwardly directed palm.

2. A method as claimed in claim 1 including determining whether a user's hand remains underneath the outlet as sensed by the hand sensor for a period of time during which the material is dispensed.

3. A method as claimed in claim 1 including recording a palm print read.

4. A method as claimed in claim 1 including recording a palm print read and whether a user's hand was maintained within the desired proximity of the outlet for a desired period of time while material was dispensed.

* * * * *